US005429018A

United States Patent [19]

Miller

[11] Patent Number: 5,429,018

[45] Date of Patent: Jul. 4, 1995

[54] RATCHET WRENCH

[76] Inventor: George Miller, 2976 Shaffer Rd., Atwater, Ohio 44201

[21] Appl. No.: 323,120

[22] Filed: Oct. 14, 1994

[51] Int. Cl.[6] ..... B25B 13/06

[52] U.S. Cl. ..... 81/186; 81/121.1; 81/119

[58] Field of Search ..... 81/186, 119, 121.1, 81/124.3, 124.7, 125

[56] References Cited

U.S. PATENT DOCUMENTS

| | | | |
|---|---|---|---|
| 2,777,353 | 1/1957 | Willis | 81/121.1 X |
| 3,635,654 | 1/1972 | McFarland | 81/63 X |
| 4,440,047 | 4/1984 | Robbins | 81/186 X |
| 5,255,578 | 10/1993 | Liou | 81/124.7 X |

*Primary Examiner*—D. S. Meislin
*Attorney, Agent, or Firm*—Terrance L. Siemens

[57] ABSTRACT

An improved ratchet wrench is disclosed that minimizes the number of moving parts that are needed in the device to provide a low torque ratcheting action along with a non-ratcheting high torque mode of operation. Proximate each of the engaging faces of the wrench head, there is an irregular pyramidal cutout. The base of the cutout is a three sided polygon and forms a trailing engagement face when the wrench head is turned in the direction for providing torque to the nut. The apex of this cutout irregular pyramid is contiguous to, and provides a perpendicular junction between, the engaging face and the face of the wrench head. Thus, when the wrench direction is reversed, the wrench head rises up away from engagement with the nut and, upon the cooperating vertices of the nut reaching the next cutout, falls back into engagement with another set of trailing engagement edges. Ratcheting action for low torque applications is thus provided. To assist in stopping the travel of the wrench head and its various engaging faces any farther than necessary down onto the nut, a number of spring loaded balls are inserted into the engagement faces. In the preferred embodiment, there are two balls on opposite engagement faces. If higher torque is desired, these balls are capable of fully recessing into their holding slots, thus allowing the device to function as a normal wrench.

1 Claim, 1 Drawing Sheet

RATCHET WRENCH

BACKGROUND OF THE INVENTION

1. Field of the Invention

The present invention relates to tools. More specifically, it relates to tools that are used to tighten and/or loosen threaded engagements. Even more specifically, it relates to a wrench wherein a ratchet type action is provided through the geometry of a plurality of angled cutouts about the periphery of the nut engaging portion of the device. In low torque applications, these cutouts provide a sufficient amount of guidance and engagement to allow the nut to be turned. When the opposite torque is applied, the angled surfaces allow the wrench to pop "up and over" allowing for ratcheting action in cramped or limited spaces. A pair of oppositely opposed spring loaded balls are present in two of the engagement faces of the unit. These allow for the unit to be pressed down onto the nut when large amounts of torque are needed to finish the engagement.

More generally, the present invention would be useful in any application where quick low torque ratcheting with a minimum of moving parts would be required, such as would be useful in corrosive liquid environments such as undersea oil wells.

2. Description of the Prior Art

Ratchet wrenches are old and popular devices. When someone needs to quickly remove various threaded engagements, one from the other, ratchet wrenches are a preferred method of accomplishing this, seeing as how the user is not required to remove the tool from the nut at the termination of the torque applying stroke. These devices are ubiquitous and many different varieties are sold under various names. The present invention seeks to obviate one of the problems extant with these devices; that is, that the profusion of moving parts therein allow for various mechanical breakdowns and potential sticking of the mechanism through exposure to viscous substances. The present invention provides the ratcheting movement through tangential angled cutout geometries proximate the flat, central nut engaging portions of the device.

During a search at the U.S. Patent and Trademark Office, the following patents were uncovered that are related to the present invention:

First is U.S. Pat. No. 2,185,002 issued on Dec. 26, 1939 to Earle A. Pack which discloses a dual reversible wrench. This apparatus has a pair of parallel heads that are journaled within hubs. A ratchet pawl connected to each of the heads allows for left handed or right handed movement of the head depending on how the pawl is adjusted. This is dissimilar from the present invention in that there is no cutout geometry taught to allow for the riding of the wrench up and out of engagement between the torque receiving and delivering surfaces of the nut and wrench, respectively.

Next is U.S. Pat. No. 2,712,259 issued on Jul. 5, 1955 to Harvey J. Cowell. This discloses an open ended ratchet system wherein a plurality of recesses carrying jaw members are disposed tangentially about the inner wall of the engaging head. These jaw members are biased such that when the wrench is turned in one direction they engage and impart rotation to the nut faces. Beveled surfaces on the jaw members are configured such that when the wrench is turned in the opposite direction, the jaw members are urged into the recesses, thus providing a ratcheting stroke. Contrast this to the instant invention wherein the cutouts proximate the flat interior engaging surfaces impel the wrench itself away from the engaging surfaces of the nut and allow the wrench to "slide" into the next engaging configuration of the alternating ratchet stroke.

In U.S. Pat. No. 2,769,360 issued on Nov. 6, 1956 to Wayne W. Cottrell there is disclosed an angular wrench head with an upwardly opening socket. A central straight handle portion has, on either of its ends, socket heads disposed at a forty five degree angle from the handle, so as to be parallel with one another. Each of the socket heads carried a socket within it, and also includes retaining walls thicker than the socket to allow a removed nut to be carried to or from an overlying stud. As in the patents discussed above, this is clearly unlike the present invention, as no angled cutouts are involved to urge the wrench away from and over the nut when the wrench is turned in a specific direction.

U.S. Pat. No. 3,635,654 issued on Jan. 18, 1972 to Frederick R. McFarland there is disclosed a multisized reversible ratchet wrench. This includes an overcenter ratchet and pawl arrangement for limiting the direction of the socket's movements, and each end of the wrench has two permanent, variously sized nut receiving sockets. There is no teaching of the angled cutouts required in the present invention.

Next is U.S. Pat. No. 4,276,791 issued on Jul. 7, 1981 to John W. Thompson. This is another device that uses a ratchet and pawl arrangement, combined with an offset handle to allow access to difficult to reach threaded engagements. On this device, the directional control for the ratchet is located on the upper extremity of the handle. As in the patents above, the ratcheting means is mechanical and there is no mention of any angled cutouts proximate the nut engaging area.

Another patent relating to ratcheting wrenches is U.S. Pat. No. 4,819,521 issued on Apr. 11, 1989 to John W. Lang. This discloses a ratchet box wrench with an offset handle. The ratcheting action in this device is also mechanical, and there is no teaching of the cutout geometry utilized in the instant invention.

Lastly, U.S. Pat. No. 5,199,332 issued on Apr. 6, 1993 to Ronald W. Batten discloses a hand wrenching tool for use with frangible fasteners. The ejector members for the device are fitted about a socket sleeve that can be retrofitted to an existing box racket wrench. Again, as in the above discussed patents, there is no teaching of the angled portions to provide the "up and back" motion of the wrench on the ratchet stroke.

None of the above inventions and patents, taken either singly or in combination, is seen to describe the instant invention as claimed.

SUMMARY OF THE INVENTION

The present invention is an improved ratchet wrench that minimizes the number of moving parts that are needed in the device to provide a low torque ratcheting action along with a non-ratcheting high torque mode of operation. Proximate each of the engaging faces of the wrench head, there is an irregular pyramidal cutout. The base of the cutout is a three sided polygon and forms a trailing engagement face when the wrench head is turned in the proper direction to provide torque to the nut. The apex of this irregular cutout pyramid is contiguous to, and provides a perpendicular junction between, the engaging face and the face of the wrench head. Thus, when the wrench direction is reversed, the wrench head rises up away from engagement with the nut and, upon the cooperating vertices of the nut reaching the next cutout, falls back into engagement with another set of trailing engagement edges. Ratcheting action for low torque applications is thus provided. To assist in stopping the travel of the wrench head and its various engaging faces any farther than necessary down onto the nut, a number of spring loaded balls are inserted into the engagement faces. In the preferred embodiment, there are two balls on opposite engagement faces. If higher torque is desired, these balls are capable of fully recessing into their holding slots, thus allowing the device to function as a normal wrench.

Accordingly, it is a major goal of the invention to provide an improved ratchet wrench tool that overcomes the disadvantages of the prior art.

Moreover, it is a principal object of the invention to provide an improved ratchet wrench that allows the user to apply low torque quickly and easily to nuts or the like while additionally being capable of standard high torque wrench operation.

It is another object of the invention to provide an improved ratchet wrench wherein the ratcheting action is provided, during low torque application, by a cut out geometry of a portion of the wrench head proximate the innermost engagement faces.

It is a further object of the invention to provide an improved ratchet wrench wherein the cutout portions are irregularly pyramidal in shape, and where the triangular base of the cutout portion forms a trailing engagement edge with the nut vertices when the wrench is turned to apply torque and where the apex of the cutout irregular pyramid is contiguous to, and forms a perpendicular junction between the wrench head face and the innermost engagement faces, whereby on reversing the direction of the wrench, the head thereof is impelled up away from the nut and slips thereover to the next set of trailing engagement faces and the cooperating nut vertices.

Still another object of the invention is to provide an improved ratchet wrench wherein the innermost engagement faces are provided with a number of spring loaded balls, and where these spring loaded balls are urged inwardly into the nut receiving area of the wrench, thus limiting unforced travel of the wrench down onto and over the nut, and where these balls are able to be completely recessed into the interior of the wrench head when the head is pushed completely over the nut, thus allowing the device to be used as a standard box wrench.

It is another goal of the invention to provide improved elements and arrangements thereof in an apparatus for the purposes described which is inexpensive, dependable and fully effective in accomplishing its intended purposes.

These and other objects of the present invention will become readily apparent upon further review of the following specification and drawings.

The present invention meets or exceeds all the above objects and goals. Upon further study of the specification and appended claims, further objects and advantages of this invention will become apparent to those skilled in the art.

BRIEF DESCRIPTION OF THE DRAWINGS

Various other objects, features, and attendant advantages of the present invention will become more fully appreciated as the same becomes better understood when considered in conjunction with the accompanying drawings, in which like reference characters designate the same or similar parts throughout the several views, and wherein.

DETAILED DESCRIPTION OF THE PREFERRED EMBODIMENT

Figure 1:
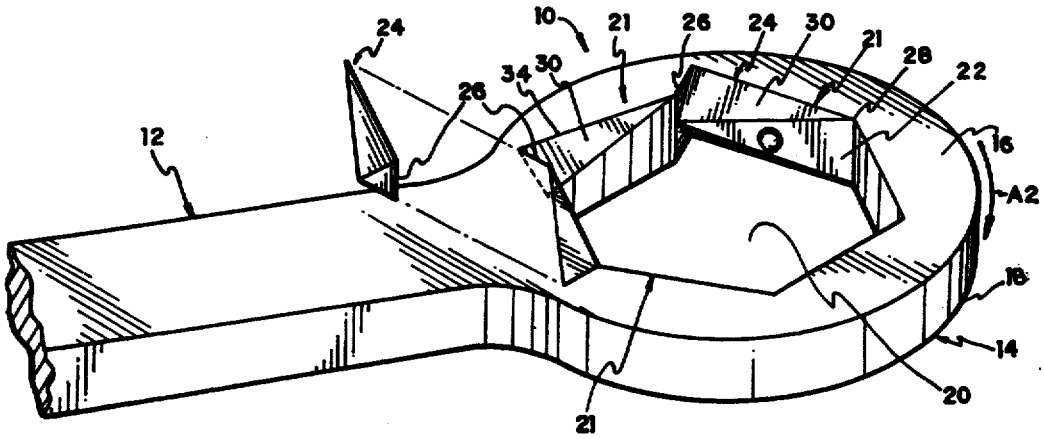
FIG. 1 is a partial environmental view of the present invention with a representation of the irregular pyramidal cutout shown being removed.
Figure 2:
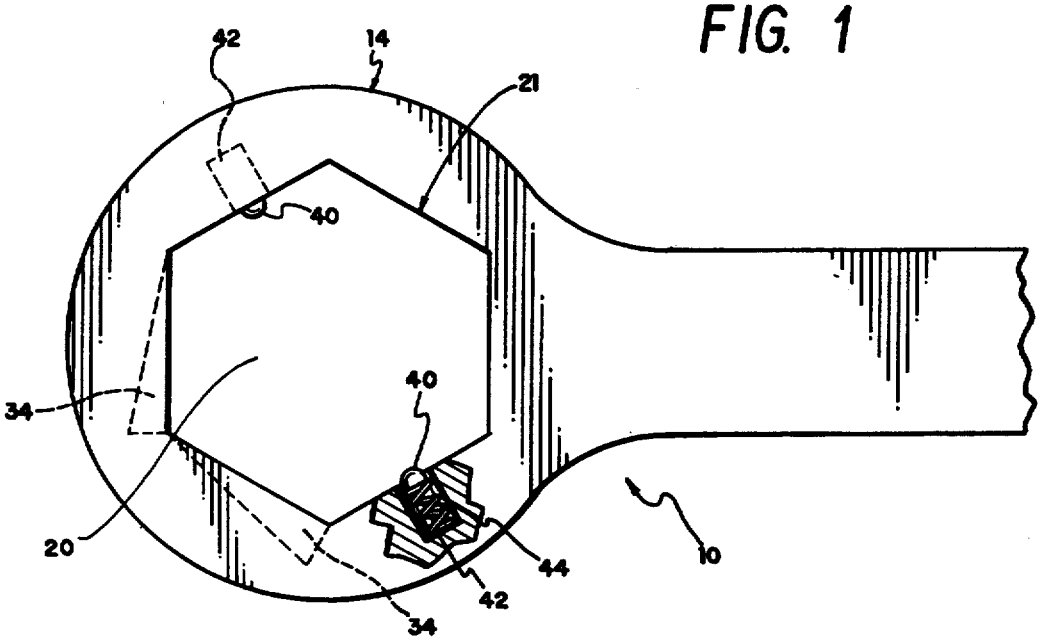
FIG. 2 is a partially cutaway plan view of the head of the improved wrench showing the biased ball detent travel stops.
Figure 3:
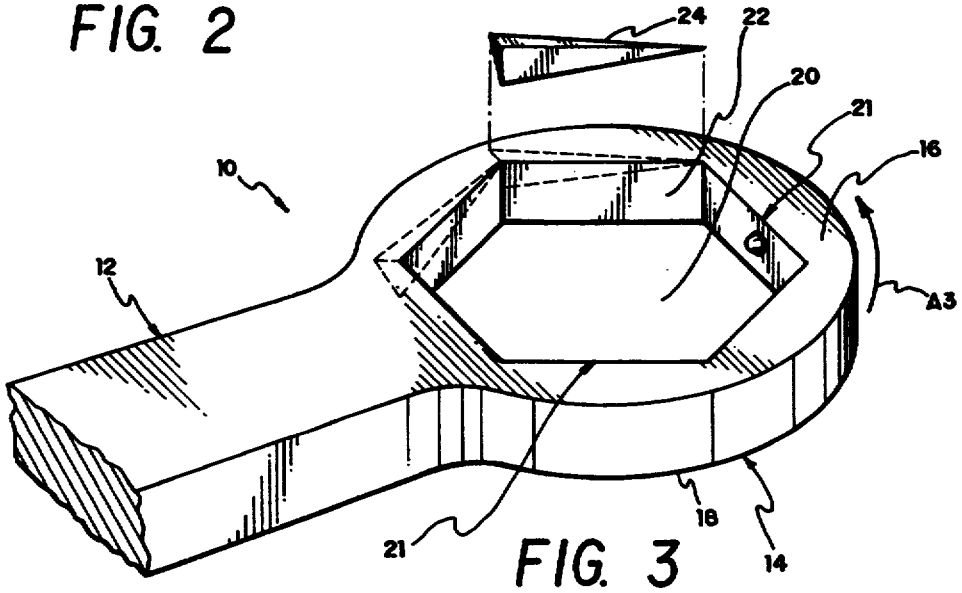
FIG. 3 is another perspective view of the invention with dotted line showings of the cutout portions.

The present invention is indicated in FIGS. 1, 2, and 3 generally at 10. There is a handle portion 12, and a wrench head portion 14. The wrench head portion 14, as seen in FIGS. 1 and 3 has a first face 16 and a second face 18. Extending from the first face 16 to the second face 18 is a socket 20. At this point it should be emphasized that though in the embodiment described herein the socket 20 extends completely between the faces 16 and 18, that this is not necessary. The socket 20 could extend only partway into the area between the faces 16 and 18 without departing from the spirit of the invention. Additionally, though a handle portion 12 is shown in this embodiment of the invention, that should not in any way be construed as a limitation in that the wrench head 14 could easily be supplied with a grip (not shown) around its periphery, obviating the necessity of a handle.

The preferred embodiment described herein is configured for use with a hex, or six sided nut. It should be emphasized that the present invention could be easily adapted for use with a wide variety of nuts having varying numbers of sides. Referring to FIGS. 1, 2, and 3, in the embodiment described herein, there are six engagement areas 21 about the periphery of the socket 20. Each of these engagement area consists of an innermost engagement face 22, with the usual dimensions that would be in place for a box type hex wrench of this size. These innermost engagement faces 22, as usual in a box wrench, are generally perpendicular to the first and second faces 16, 18 of the wrench head 14. Adjacent to the inner engagement faces are the cutout portions 24. These cutouts are in the shape of an irregular pyramid having a triangular base 26. As can be seen most clearly in FIG. 1, these triangular cutout bases form a shoulder that serves to engage the nut periphery in a low torque application of the wrench 10, as will be discussed hereinafter. At the opposite end of each of the cutout portions 24 from the base or shoulder 26 is a cutout apex 28. This cutout apex is contiguous to both the inner engagement faces 22 and the wrench head face 16 and also defines a perpendicular junction in respect to both. Lying between the base 26 and the apex 28 on each of the cutout portions 24 is a smooth facet or camming area 30 that serves to guide the wrench head 14 up from and over the nut (not shown) on the ratcheting stroke as will be discussed further below. The distance that shoulder or base 26 extends axially into the face 16 of the wrench head 14 is not critical, however it should be not extend too great a distance as this would extend the ratcheting or camming stroke. The camming area 30 is smooth and has a bottom edge 32 and a top edge 34 that extends tangentially in relation to the bottom edge, as best seen in FIG. 2.

The discussion now turns to the ball detent means that are located on and within the innermost engagement faces. In the preferred embodiment of the invention the ball detents number two and are located on oppositely disposed faces, as is seen in FIG. 2. Other arrangements could, of course be utilized without departing from the spirit of the invention. The ball detents 40 are retained inside recesses 42 (shown in FIG. 2) that are axially disposed within the wrench head 14. Within each recess 42 there is a biasing means 44 that urges the ball detent 40 inward, in the direction indicated by directional arrow A1 in FIG. 2, such that the ball 40 protrudes into the socket 20. The ball detents 40 thus provide a travel stop to prevent the inner engagement faces 22 in the socket 20 from entirely engaging the nut (not shown). This allows the low torque turning of the nut through utilization of the cutout bases or shoulders 6 engaging the periphery of the nut when the wrench 10 is turned in the direction indicated by arrow A2 in FIG. 1. Additionally, if the user wishes to use wrench 10 as a normal box wrench, they may simply press the wrench head 14 down and the ball detents 40 will be forced fully into the recess thus allowing proximal contact between the inner engagement faces 22 and the periphery of the nut.

The discussion now turns to the use of the device 10. In loose engagement with a nut, not all of the base shoulders 26 would be completely engaged therewith, but as this is a low torque application, that is not an overwhelming drawback. The wrench 10 is turned in the direction indicated by arrow A2 (as mentioned above) and the nut will be turned in the like direction by its loose engagement with the trailing cutout base portions 26. When the wrench 10 is turned in the direction indicated by arrow A3 in FIG. 3, the camming surface 30 will impel the wrench 10 (assuming the nut to be fixed) "downwards" in relation to the way the apparatus is depicted in the Figure. This motion away from the nut will continue until the area proximate the vertices of the nut slide over the apex 28 of the cutout portion 24 and engage the next set of trailing edge base cutout portions 26. Thus, in a confined space, the instant invention may be used a low torque ratchet-type wrench, having almost no moving parts to be fouled or corroded. Additionally, by exerting extra force to impel the nut past the ball detents 40, the innermost engaging faces 22 are brought into proximal contact with the periphery of the nut, allowing the wrench 10 to be used in a manner similar to that of a standard box wrench.

It is to be understood that the present invention is not limited to the sole embodiment described above, but encompasses any and all embodiments within the scope of the following claims.

I claim:

1. An improved construction for a wrench comprising:

main body portion including a gripping and manipulation means, said main body having a first face and a second face, said first and said second face being generally parallel to one another and being fixed in a spaced apart relationship;

socket means having a periphery and a center, said socket means including a plurality of engagement areas located about said periphery, and where each of said engagement areas includes an inner engagement face perpendicular in relation to both said first and said second faces;

an irregular pyramidal cutout located between each of said inner engagement areas and at least one of said faces of said main body, said cutout portion being thereby proximal to both, said irregular cutout portion defining a triangular shoulder at the base of said cutout portion, an apex distal from said triangular shoulder, said apex being contiguous to and describing a perpendicular junction between said inner engagement face and said proximate face of said main body, and a triangular camming surface, said camming surface having a first edge proximate said inner engagement face, a second edge proximate to said proximal face of said main body and a third edge defining a right angle boundary between said camming surface and said triangular shoulder; and resilient workpiece travel stops located on at least two of said inner engagement faces, said travel stops being resilient axially from said center of said socket means; whereby low torque force can be applied to a workpiece, nut, or like device through said triangular shoulders when said wrench is placed over the workpiece up to said resilient travel stops on said inner engagement faces and said wrench is turned in a first direction allowing said triangular shoulders to engage a plurality of the vertices on the workpiece nut, and a ratcheting action is effected when said wrench is turned in a second direction causing the vertices on the workpiece nut to engage said triangular camming surface, thus sliding the vertices over to engage another of said triangular shoulders.

* * * * *